US006067051A

United States Patent [19]

Terk et al.

[11] Patent Number: 6,067,051

[45] Date of Patent: May 23, 2000

[54] APPARATUS AND METHOD OF MOUNTING VHF/UHF ANTENNA ASSEMBLY ON SATELLITE DISH ANTENNA

[75] Inventors: Neil D. Terk, Laurel Hollow, N.Y.; Luc Heiligenstein, Chicago, Ill.; Stephen Melamed, Chicago, Ill.; Sabrina L. Tongish, Chicago, Ill.

[73] Assignee: Terk Technologies, Inc., Plainview, N.Y.

[21] Appl. No.: 09/220,282

[22] Filed: Dec. 23, 1998

[51] Int. Cl.[7] ..... H01Q 21/00

[52] U.S. Cl. ..... 343/727; 343/725

[58] Field of Search ..... 343/725, 727, 343/730, 761, 779, 832, 839, 878, 892, 912, 916; 248/226.11, 226.12, 228.6, 228.8, 230.6, 230.7, 231.71, 231.81, 231.85, 316.1, 316.8

[56] References Cited

U.S. PATENT DOCUMENTS 1,283,451 11/1918 Bale ..... 248/313

4,388,624 6/1983 Dupressoir ..... 343/727

5,929,818 7/1999 Snyder ..... 343/725

*Primary Examiner*—Don Wong

*Assistant Examiner*—Jennifer H. Malos

*Attorney, Agent, or Firm*—Hoffmann & Baron, LLP

[57] ABSTRACT

An antenna assembly is disclosed that comprises a terrestrial antenna and a support that mounts the antenna assembly on a satellite dish antenna. The satellite dish antenna has a convex/concave configuration, a periphery, a front signal receiving surface. The terrestrial antenna comprises a pair of dipoles. The support comprising a pair of sleeves for readily receiving and supporting the pair of dipoles respectively in a substantially parallel relationship to each other, and a support variably mounting the terrestrial antenna on the satellite dish antennas of varying size and configuration.

13 Claims, 4 Drawing Sheets

APPARATUS AND METHOD OF MOUNTING VHF/UHF ANTENNA ASSEMBLY ON SATELLITE DISH ANTENNA

FIELD OF THE INVENTION

This invention relates to the ready assembly of satellite dish type antennas and UHF/VHF antennas either as an after market or direct marketed product.

BACKGROUND OF THE INVENTION

Satellite dish antennas have gained popularity, in part, for their capability to provide TV programming from a number of program sources greater than that available from the local, terrestrial VHF and UHF stations. However, such dish antennas are adapted to receive video signals from satellites disposed in synchronous or stationary orbits about the earth to the exclusion of the locally transmitted VHF and UHF signals. To enable reception of locally transmitted video signals and the locally produced TV programs, it is necessary to also employ antennas that are adapted to receive signals in the VHF and UHF ranges.

U.S. Pat. No. 5,606,334 of Amarillas et al. relates to a combination of a compact, rectangularly shaped assembly of a reflector or dish with fragmented curved surfaces and a VHF/UHF antenna, which is mounted on the reflector. Further, an amplifier processes the signals from the reflector and its waveguide. The antenna is mounted on the periphery of the reflector and its cover.

U.S. Pat. No. 5,793,336 of Shoemaker et al. discloses the combination of two antennas, the first comprises a nonconductive layer on which is deposited first and second radiators, and the second is in the form of a double curved dish. The first antenna is disposed in a housing, which includes a back plate. The plate conforms to the shape of the back of the double curved dish against which it is mounted.

None of the patents discussed above deal with the needs or problems presented by the aftermarket, where it is often desired to add UHF/VHF reception capability to an installed satellite dish antenna. Of course, a second UHF/VHF antenna could be installed at the expense of the esthetic appearance of the structure, e.g., a residence, to which two antennas are mounted. The resultant assembly of dish and UHF/VHF antennas must, of course, function when so assembled to receive their respective spectrums of the wireless video signal transmissions.

In a copending patent application Ser. No. 08/856,388, entitled "COMBINATION SATELLITE DISH WITH UHF/VHF ANTENNA" and filed May 15, 1997 in the name of Donald L. Snyder, there is disclosed an assembly comprising in its four figures a dish antenna and a UHF/VHF antenna, which includes two dipoles or portions. These portions are bent into a configuration similar to that of the dish. The UHF/VHF antenna is secured to the dish by supports. These supports are only described in the application as follows, "Supports 60 interposed between the portion 58 and the shell periphery 38, and the portion 56 and the shell periphery 38 support the upper region of the UHF/VHF antenna."

There are known a number of satellite dish antennas, which have different configurations. One such dish antenna is marketed under the trade name, Sat-Trol Satellite Dish and has at its periphery a lip. This lip is of a cylindrical configuration and extends from a rear side opposite to the front receiving side. A device or support is provided to secure an UHF/VHF antenna, e.g., a Sat-Trol antenna, to the Sat-Trol Satellite antenna. That securing device is made of plastic that has some flexibility and has a slot of a configuration to receive and secure therein the lip of the Sat-Trol Satellite Dish, whereby the UHF/VHF antenna may be mounted with respect to this Satellite Dish. However, this securing device is so designed, i.e., its slot is so configured to only receive the particular antenna, as to be used only with the Sat-Trol Satellite Dish. It would be desired, as taught by this invention, to have a securing device that is adaptable to receive readily and to be mounted firmly to any number of satellite dishes regardless of their configuration.

In addition, the Sat-TrolR UHF/VHF antenna includes a rectangularly shaped antenna holder, which is inserted into that bracket which is attached to the rear side of the satellite dish antenna. The dipoles of the Sat-TrolR UHF/VHF antenna are fixedly secured to the antenna holder. The cross-section of the mounting bracket is of a like configuration to that of the antenna holder, whereby the holder may be slid into the mounting bracket and secured thereto by a screw to provide further support for the UHF/VHF antenna with respect to the bracket.

However, in view of the art considered as a whole at the time the present invention was made, it was not obvious to those of ordinary skill in this art how the needed improvements could be provided.

SUMMARY OF THE INVENTION

It is therefore an object of this invention to provide a new and improved antenna subassembly adapted to be mounted readily on a satellite dish antenna and to be connected to its satellite receiver.

It is another object of this invention to provide a new and improved antenna subassembly that is mounted readily on a variety of satellite dish antennas of varying shape and dimension.

These and other important objects, features, and advantages of the invention will become apparent as this description proceeds. This invention involves an antenna assembly which comprises a mounting base adapted to be secured to a structure, a satellite dish antenna and a terrestrial antenna. The satellite dish antenna has a convex/concave configuration, a periphery, a front signal receiving surface and a rear surface. The rear surface is secured to a support base. The terrestrial antenna comprises a pair of dipoles. A support mounts the antenna assembly and comprises a pair of sleeves for readily receiving and supporting the pair of dipoles of the antenna assembly respectively in a substantially parallel relationship to each other, and a member which readily supports the terrestrial antenna to a variety of satellite dish antennas of different sizes and configurations.

In a further aspect of this invention, the readily mounting support comprises a clamp. The clamp includes a support member with opposing ends, a stop member affixed to one of the opposing ends, a thumb screw, a support member having an opening therethrough for rotatably receiving the thumb screw and a thumb screw wheel for threadably receiving the thumb screw. The thumb screw wheel is rotatable to drive rectilinearly the thumb screw in two directions dependent on the direction of rotation imparted to the thumb screw.

In further aspect of this invention, the support comprises at least one bracket and a support member. The bracket is secured to the rear surface of the satellite dish antenna at a point adjacent its periphery. The support member defines the pair of sleeves and the arm. The bracket defines an opening for receiving the arm, whereby the UHF/VHF antenna is readily mounted on the satellite dish antenna.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DESCRIPTION OF THE PREFERRED EMBODIMENT OF THIS INVENTION

Figure 1A:
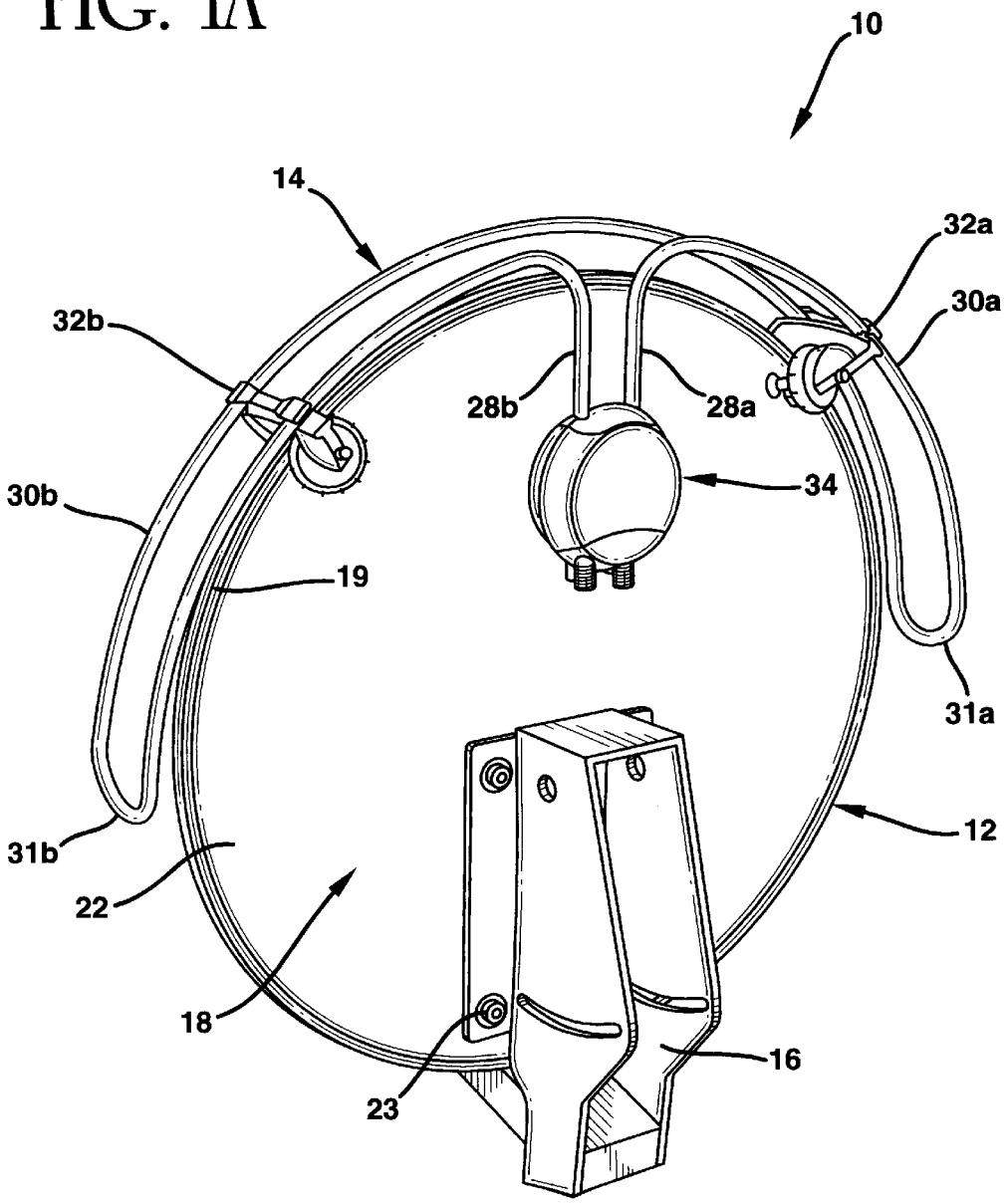
FIGS. 1A and B are respectively rear and front perspective views of an antenna assembly that includes a video satellite dish antenna and a UHF/VHF antenna and a device for readily mounting the UHF/VHF antenna to the dish antenna in accordance with the teachings of this invention.

Referring now to the drawings and in particular to FIGS. 1A and B, there is shown an antenna assembly represented generally by numeral 10 that comprises a dish shaped satellite antenna identified by the numeral 12 for receiving TV or video signals transmitted from satellites that are placed in a stationary or asynchronous orbit about the earth, a UHF/VHF antenna identified by the numeral 14 for receiving video signals of such bandwidths from a local, terrestrially based transmitter of such signals, and at least one support identified by the numeral 32 for mounting the UHF/VHF antenna 14 in the assembly 10 with respect to the satellite dish antenna 12.

Figure 1B:
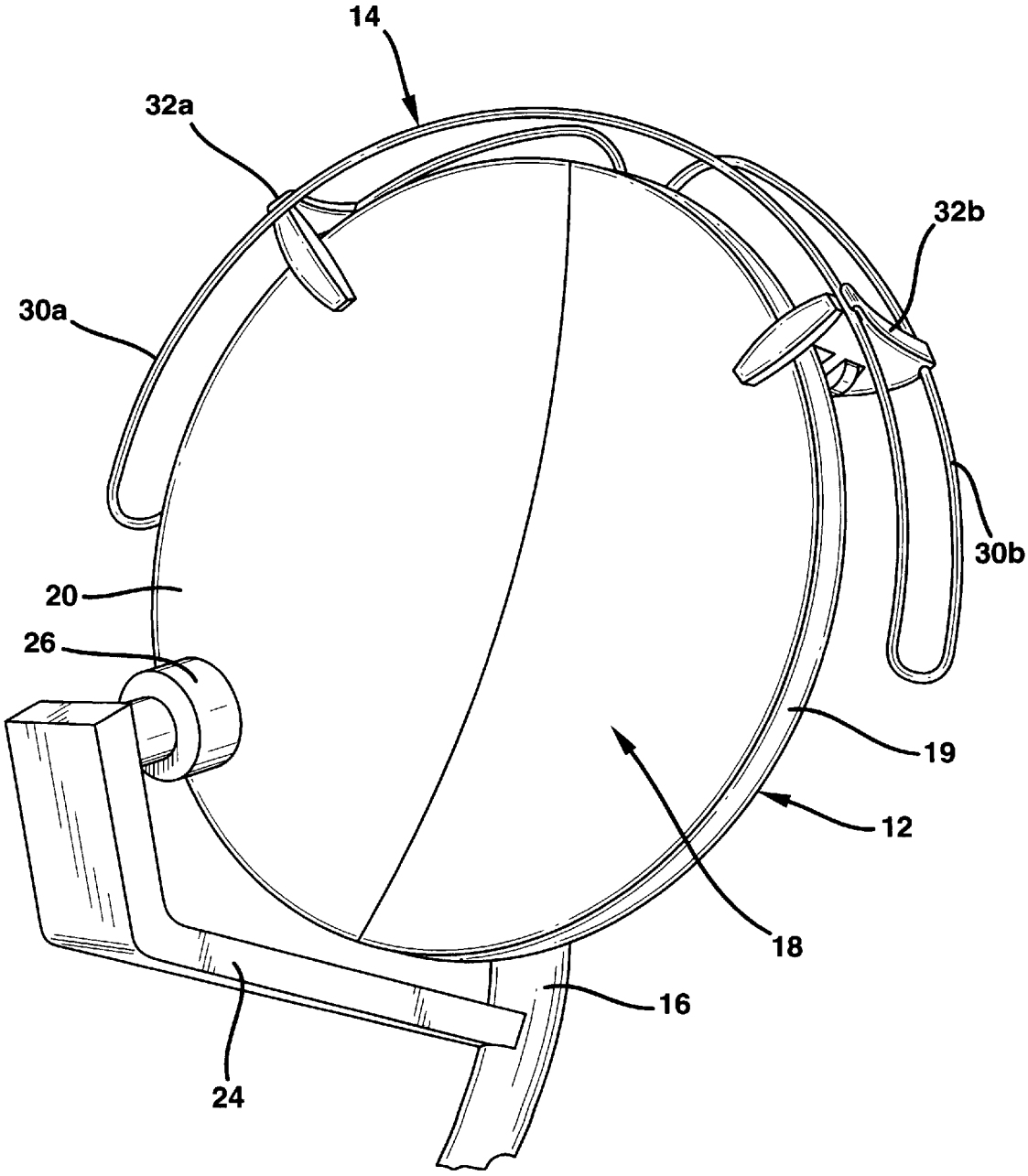

Still referring to FIGS. 1A and B, the antenna assembly 10 and, in particular, the satellite dish antenna 12 is supported upon a base 16, which is in turn adapted to be fixedly secured to a structure, e.g., a residence, where the TV receiver is placed. Typically, the antenna assembly 10 is mounted to permit a line of sight orientation between the dish antenna 12 and the satellite from which the video signals are transmitted. The satellite dish antenna 12 comprises a shell 18 which is of concave/convex configuration that is well known in the art. As illustrated in FIG. 1, the shell 18 has a periphery 19 which is of a substantially circular configuration. The dish antenna 12 has a front, signal receiving side 20 as shown in FIG. 1B and a rear side 22 as shown in FIG. 1A. The support base 16 is affixed to the rear side 22 by suitable fasteners such as the nuts and bolts collectively identified by the numeral 23.

As shown in FIG. 1B, a support arm 24 is affixed to the support base 16 to extend upwardly from the base 16 and forwardly of the front side 20 to support at least one sensor 26 at a focal point of the signals reflected from the front signal receiving side 22 of the concave/convex shaped shell 18.

Still referring to FIGS. 1A and B, the UHF/VHF antenna 14 includes a pair of dipoles 28*a* and *b,* each of which extends upwardly from a housing 34 in a substantially vertical direction, before being bent away from each other in opposite directions to form a pair of u-shaped arms 30*a* and *b.* Each of the arms 30*a* and *b* extends away from its dipole 28*a* or *b,* respectively. At the remote ends, each arm 30 is bent in a U-shaped byte 31 before extending back towards each other and being connected to the other arm. The first and second arms 30*a* and *b* are configured to follow the circular periphery 19 of the dish antenna 12. As shown in FIGS. 1A and B, the spacing between the first and second arms 30*a* and *b* and the periphery is kept substantially equal.

At least one support 32 is interposed between the dish antenna 12 and the UHF/VHF antenna 14 to wholly support the UHF/VHF antenna 14 upon the satellite dish antenna 12. As described above, the dish antenna 12 is mounted from a structure by the support base 16. In this manner, this illustrated embodiment of this antenna assembly eliminates the need for a second base to support two UHF/VHF antennas from the structure.

Further, the support 32 permits the mounting of the UHF/VHF antenna 14 to satellite dish antennas of varying dimensions and configurations. In the claims that follow, the term a "variably mounting" support shall be interpreted as including a support that may so mounted to a variety of satellite dish antennas of varying size and configuration. For example, the for the Sat-T Trol Satellite Dish is not "variably mounting" in that its support is particularly adapted to mount satellite dish antennas of a particular configuration, namely a satellite dish with a cylindrically-shaped lip. In the following, a number of embodiments of the support 32 will be described that are deemed to be "variably mounting". The "variably mounting" support of this invention as so described is adapted to be mounted not only on the Sat-Trol Satellite antenna, but also those satellite dish antennas as manufactured by Sony and RCA.

Figure 2A:
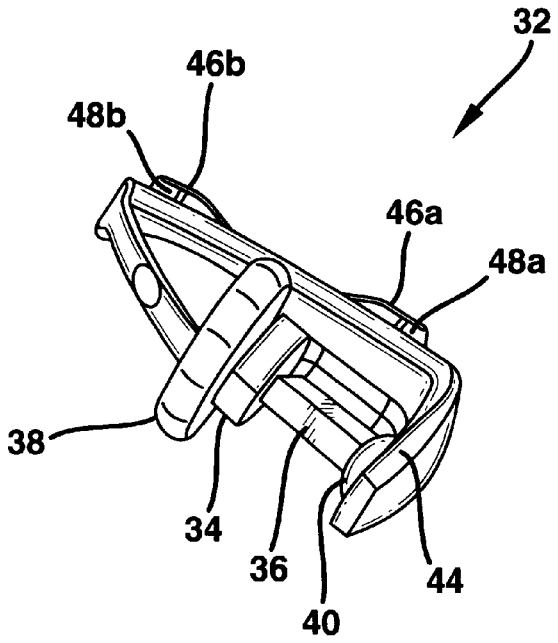
FIGS. 2A and B are respectively a perspective view and a side view of the device as shown in FIG. 1 for mounting the antennas with respect to each other in accordance with one embodiment of this invention.

A first embodiment of the supports 32 is generally shown in FIGS. 1A and B and more fully in FIGS. 2A and B. In this illustrative embodiment of the invention, the supports 32 are C-shaped and comprise a base member 50 which has opposite ends, a stop arm 44 affixed at one end and a support member 34 affixed also to the base member 50 and spaced from the stop arm 44. A threaded, thumb screw 36 is rotatably received through an opening made in the support member 34. A plunger 40 is affixed to a free end of the thumb screw 36. A thumb screw wheel 38 has a central opening there through for threadably receiving the other end of the thumb screw 36, whereby an antenna installer may readily rotate wheel 38 in either direction. Rotation of the wheel 38 in a clockwise direction will move the plunger 40 toward the stop member 44 and in a counter-clockwise direction will move the plunder 40 away from the stop member 44.

Figure 2B:
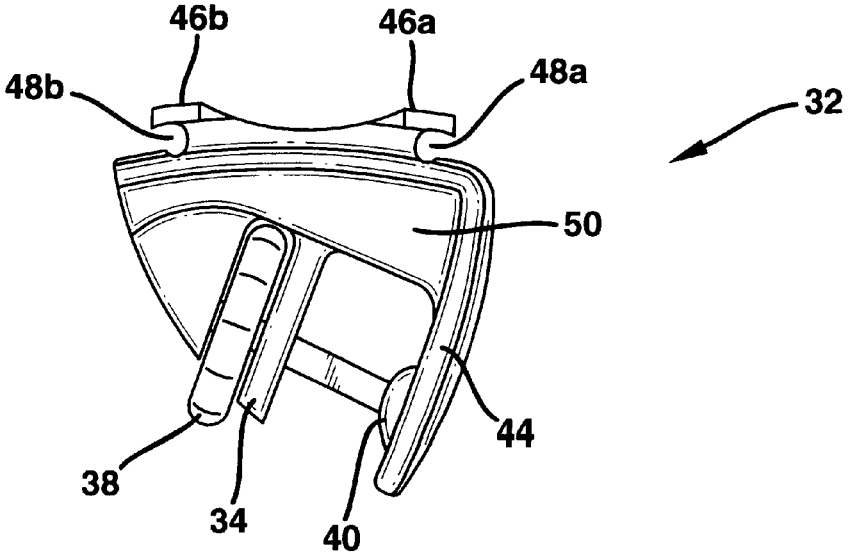

As best shown in FIG. 2B, the support 32 further includes a pair of dipole connecting arms 46*a* and *b,* both of which are connected at one end to the top of the base member 50 and respectively extend upward and in opposite directions. In the other ends of the arms 46*a* and *b,* circular slots 48*a* and *b* are respectively formed. The slots 48*a* and *b* are of a configuration and diameter similar to that of the dipoles 28*a* and *b,* whereby the dipoles 28*a* and *b* may be respectively press fitted into the slots 48*a* and *b,* whereby the dipoles 28*a* and *b* may be releasably secured therein and the UHF/VHF antenna 14 securely mounted to the support 32, as shown in FIG. 1. When so attached to slots 48*a* and *b,* the dipoles 28*a* and *b* are so held in a substantially parallel relationship to each other. It is understood that the attaching of the UHF/

VHF antenna 14 to the support 32 does not require any special tools and may be quickly done by an unskilled person.

The next mounting step, as best shown in FIG. 1A, involves securing one or more of the supports 32 to the periphery 19 of the shell 18. This is accomplished by rotating the thumb screw wheel 38 in the clockwise direction to withdraw the plunger 40 from the stop member 44 and to provide thereby a space of sufficient dimension to permit the shell 18 to be inserted into that space, before the thumb crew wheel 38 is then rotated in the opposite, counter-clockwise direction whereby the thumb screw 36 and the plunger 40 are driven in the opposite direction until the plunger 40 engages the front, signal receiving side 20 and the support 32 is secured to the shell 18 as best shown in FIG. 1B. Again, it is understood that mounting the supports 32 to the dish antenna 12 may be readily carried out manually and quickly by an unskilled person without any tools. In this embodiment as illustrated in FIGS. 1A and B, the supports 32 are so mounted with respect to dish antenna 12 so that their thumb screw wheels 38 are disposed on the rear side 22 of the shell 18 to prevent interference of the TV video signals directed on to the front signal receiving side 20.

Figure 3:
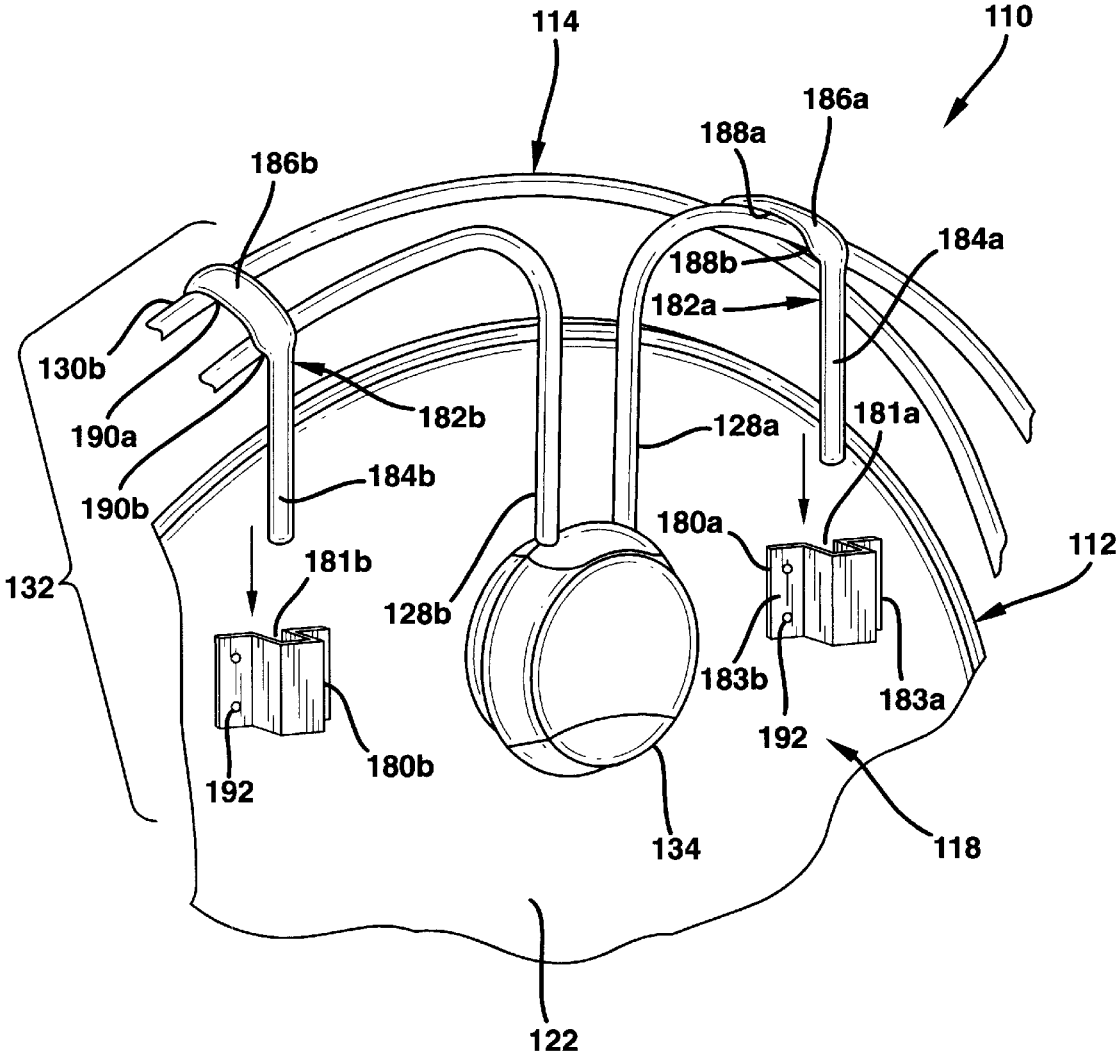
FIG. 3 is a side view of the device for mounting the antennas with respect to each other in accordance with a further embodiment of this invention employing at least one bracket affixed to the dish antenna and a member or arm readily attachable to the UHF/VHF antenna that is particularly adapted to engage readily the bracket whereby the these antennas are mounted in an assembled relationship with each other.

A further embodiment of the supports is shown in FIG. 3, wherein like elements are identified by like numerals but in the hundreds. The supports are so identified by the numeral 132, while the UHF/VHF antenna is identified by the numeral 114 and the dish antenna by the numeral 112. Each of the supports 132 includes an U-shaped bracket 180 and a mating support member 182. Each bracket 180 is U-shaped to define an opening therethrough selected to be of a diameter to receive the member 182 as will be explained below. Each bracket 180 also includes a pair of mounting flaps 183*a* and *b* which extend from either side thereof as shown in FIG. 3. A plurality of welds 192 are made to secure each of the flaps 183*a* and *b* to the rear side 122 of the shell 118.

Each of the support members 182 includes a support arm 184 that extends downwardly as shown in FIG. 3 and a dipole connecting strap 186 that extends normally to its arm 184 and is integrally connected therewith, for example. The configuration and diameter of the arms 184 are selected with respect to the diameter of the brackets 180 to ensure a tight fit there between when an arm 184 is pressed into a corresponding U-shaped bracket 180. The dipole connecting straps 186 are adapted to be secured to a pair of the dipoles 128. In particular, each strap 186 includes a pair of support sleeves 190*a* and *b*. Each sleeve 190 is made of a configuration and dimension similar to that of the dipoles 128 to permit the dipoles 128 to be inserted therein by hand and, thereafter, to be securely held therein by force fit. The axis of each of the sleeve 186*a* is parallel to the axis of the sleeve 186*b*, whereby, when the dipoles 128 are pressed into their corresponding sleeves 186*a* and *b*, the dipoles 128 will be supported in a substantially parallel relationship with respect to each other as shown in FIG. 3. The mounting of the UHF/VHF antenna 114 on the dish antenna 112 is a relatively simple process. First, the dipole connecting straps 186 are secured to the dipoles 128, i.e., the dipoles 128 are forced fit into their respective support sleeves 188*a* and *b*. Then the support arms 184 are pressed fit into the U-shaped brackets and thus the UHF/VHF antenna 114 is securely and quickly mounted on the dish antenna 112 by an unskilled person without any tools.

It will thus be seen that the objects set forth above, and those made apparent from the foregoing description, are efficiently attained and, since certain changes may be in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An antenna assembly, comprising:

a) a mounting base adapted to be secured to a structure;

b) a satellite dish reflector having a convex/concave configuration, a periphery, a front signal receiving surface and a rear surface, said rear surface being secured to said support base;

c) a terrestrial antenna comprising a pair of dipoles; and d) a support comprising a pair of sleeves for readily receiving and supporting said pair of dipoles respectively in a substantially parallel relationship to each other about at least a portion of the circumference of said reflector, said support variably mounting said terrestrial antenna to said satellite dish reflector.

2. The antenna assembly as claimed in claim 1, wherein said variably mounting support comprises a clamp having open channels for accepting said dipoles.

3. The antenna assembly as claimed in claim 2, wherein said clamp comprises a support member with opposing ends, a stop member affixed to one of said opposing ends, a thumb screw, a support member having an opening there through for rotatably receiving said thumb screw and a thumb screw wheel for threadably receiving said thumb screw and rotatable to drive rectilinearly said thumb screw in two directions dependent on the direction of rotation imparted to said thumb screw.

4. The antenna assembly as claimed in claim 3, wherein said thumb screw may be driven in a direction away from said stop member a distance to define a space there between sufficient to receive therein at least said periphery of said satellite dish antenna.

5. The antenna assembly as claimed in claim 4, wherein said thumb screw wheel is oriented so as not to block satellite signal transmission to said front signal receiving surface.

6. The antenna assembly as claimed in claim 2, wherein said open channels for accepting said dipoles receive said dipoles in a press-fit relationship.

7. The antenna assembly as claimed in claim 6, wherein said open channels for accepting said dipoles have openings that are faced in substantially opposite directions.

8. The antenna assembly as claimed in claim 1, wherein said variably mounting support comprises at least one bracket secured to said rear surface of said satellite dish reflector at a point adjacent said periphery of said satellite dish reflector and at least one support member having a pair of sleeves and an arm, said bracket defining an opening for receiving said arm, and said pair of sleeves defining openings for retaining said dipoles, whereby said terrestrial antenna is readily mounted on said satellite dish reflector.

9. The antenna assembly as claimed in claim 8, wherein said pair of sleeves have open channels for accepting said dipoles and mounting said dipoles on said satellite dish reflector.

10. The antenna assembly as claimed in claim 9, wherein said open channels for accepting said dipoles receive said dipoles in a press-fit relationship.

11. The antenna assembly as claimed in claim 9, wherein said open channels for accepting said dipoles have openings that are faced in substantially opposite directions.

12. A UHF/VHF antenna subassembly adapted to be coupled to a satellite dish antenna reflector to form an antenna assembly therewith, said subassembly comprising:

a) a terrestrial antenna comprising a pair of dipoles; and b) a support comprising a pair of sleeves for readily receiving and supporting each of said pair of dipoles in a substantially parallel relationship to each other about at least a portion of the circumference of said reflector, said support for variably mounting said terrestrial antenna to a variety of satellite dish reflectors.

13. A UHF/VHF antenna subassembly adapted to be coupled to a satellite dish antenna reflector to form an assembly therewith, the dish antenna reflector having at least one bracket secured to its rear surface, the bracket defining an opening of given dimension and configuration, said subassembly comprising:

a) a terrestrial antenna comprising a pair of dipoles; and b) a support comprising an arm and a pair of sleeves for readily receiving and supporting each of said pair of dipoles in a substantially parallel relationship to each other about at least a portion of the circumference of the reflector, said arm being dimensioned and configured to be received within the bracket opening for mounting said terrestrial antenna to the reflector.

* * * * *